US008671477B1

(12) United States Patent
Joyner

(10) Patent No.: US 8,671,477 B1
(45) Date of Patent: Mar. 18, 2014

(54) MATTRESS SKIRT

(71) Applicant: Angela Joyner, Miami Beach, FL (US)

(72) Inventor: Angela Joyner, Miami Beach, FL (US)

( * ) Notice: Subject to any disclaimer, the term of this patent is extended or adjusted under 35 U.S.C. 154(b) by 0 days.

(21) Appl. No.: 13/972,884

(22) Filed: Aug. 21, 2013

(51) Int. Cl.
*A47C 21/02* (2006.01)
*A47G 9/02* (2006.01)

(52) U.S. Cl.
USPC ..... 5/493

(58) Field of Classification Search
USPC ..... 5/493, 498, 499, 482, 485, 503.1, 5/504.1, 658, 659
See application file for complete search history.

(56) References Cited

U.S. PATENT DOCUMENTS

| | | | | |
|---|---|---|---|---|
| 3,585,660 | A | 6/1971 | Gottfried | |
| 3,606,622 | A * | 9/1971 | Williams et al. | 5/498 |
| 4,686,726 | A * | 8/1987 | Dunfee | 5/498 |
| 5,325,554 | A * | 7/1994 | Lewis | 5/498 |
| 5,483,712 | A * | 1/1996 | Greenwood | 5/493 |
| 5,745,940 | A | 5/1998 | Roberts | |
| 5,926,874 | A | 7/1999 | Browder | |
| 5,966,758 | A * | 10/1999 | Karam | 5/493 |
| 6,883,192 | B1 * | 4/2005 | Rose et al. | 5/493 |
| 6,925,667 | B2 | 8/2005 | Cohen | |
| 7,793,370 | B2 * | 9/2010 | Hampton | 5/493 |
| 7,984,522 | B1 | 7/2011 | Pfleger | |
| 8,245,333 | B2 | 8/2012 | Hamilton | |
| 8,393,024 | B2 | 3/2013 | Mitchell | |
| 2006/0288481 | A1 * | 12/2006 | Hampton | 5/493 |
| 2009/0089929 | A1 * | 4/2009 | Hampton | 5/493 |
| 2012/0233775 | A1 | 9/2012 | Flinn | |

* cited by examiner

*Primary Examiner* — Robert G Santos
(74) *Attorney, Agent, or Firm* — Christopher J. Vandam, PA; Chris Vandam

(57) ABSTRACT

A mattress skirt applied to a bed for concealing an edge of a mattress. The mattress skirt has a horizontal panel that is inserted between a mattress and box spring and a vertical panel that drapes over an edge of the mattress. The mattress skirt has a plurality of pockets on the horizontal panel, each dimensioned to receive a batten. A batten is inserted into a pocket to install the horizontal panel between the mattress and box spring.

7 Claims, 2 Drawing Sheets

MATTRESS SKIRT

BACKGROUND OF THE INVENTION

1. Field of the Invention

The present invention relates to bedding accessories, and more particularly, to a skirt used to cover an edge of a bed.

2. Description of the Related Art

Several designs for mattress skirts have been designed in the past. None of them, however, includes a way to avoid lifting the mattress to place a mattress skirt over a box spring resulting in a much easier chore of dressing a bed.

Applicant believes that the closest reference corresponds to U.S. Pat. No. 7,793,370 issued to Hampton. However, it differs from the present invention because, among several other reasons, the Hampton device is comprised of "multiple ruffle inserts . . . [that] completely surround the perimeter of the box spring." In contrast, a version of the present disclosure utilized one panel per side of a bed or one panel that contiguously covers multiple sides of a bed or box spring.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a mattress skirt that is easy to apply and remove from a bed.

It is another object of this invention to provide a mattress skirt that can be applied by one person without heavy lifting.

It is still another object of the present invention to provide a mattress skirt without complicated fasteners that also conceals corners and/or edges of a bed with a decorative treatment.

Another benefit of use of a mattress skirt as described is to limit visual access as well as provide a barrier to dust and dirt from transiting under a bed.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

The mattress skirt described herein is typically used in conjunction with a common bed. A common bed usually will have at least one of a mattress, a box spring or a frame. Many modern beds will have a combination of a mattress placed on top of a box spring where the mattress and box spring have a similar foot print dimension.

Other widely available beds have a mattress layer (or other soft bedding material) covering a frame. This type of configuration can be seen in beds such as a futon, cot, couch-type pull out bed or murphy bed styles, for example.

The mattress skirt may also be effectively utilized with other types of beds such as an air mattress placed on a frame, floor or other support structure. Similarly, a waterbed or other bladder based bed could also be improved by the addition of such a mattress skirt.

Almost any conceivable type of bedding configuration could be used with at least one of the versions of mattress skirts as described herein. There are many styles of beds known in the art, almost all of which could be used directly with or adapted to be compatible with a mattress skirt as shown and described.

Any of the types of bedding configuration are intended to work well with the mattress skirt. For illustration purposes a mattress and box spring is discussed in the description herein. Similar use for any bedding type should be understood to be implied into discussion citing a mattress and box spring combination.

Any of the versions of mattress skirts described herein are generally made of common bedding materials including both flexible and rigid materials. For example any of the versions of mattress skirts (except the battens which are addressed specifically below) could be made of fabric, leather, lace, rigid boards or panels or any other material known or commonly available that could be conformed to the shape of the mattress skirt as shown and described.

Figure 1:
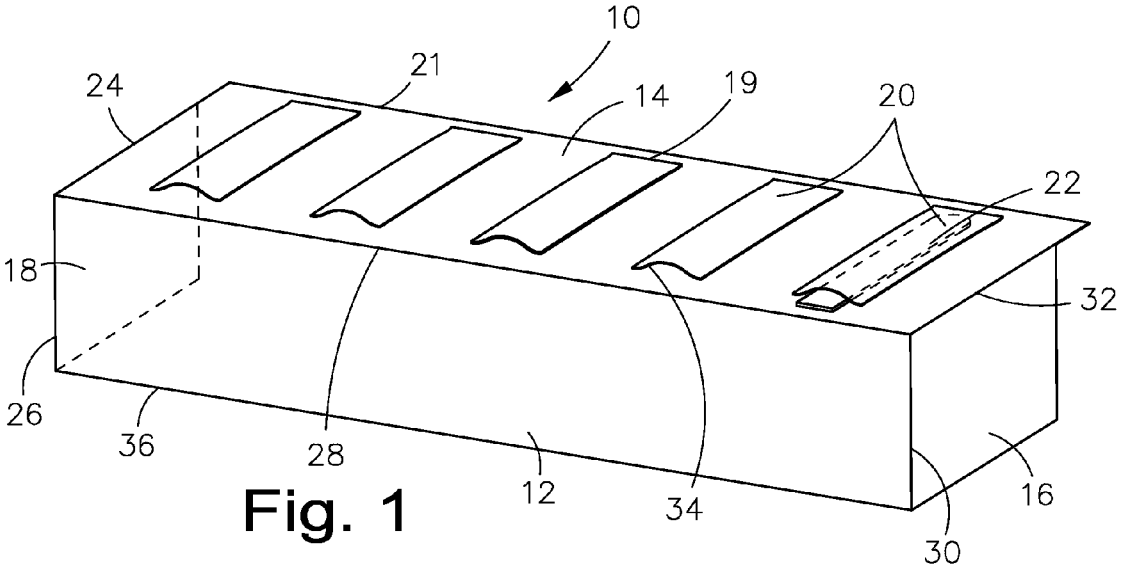
FIG. 1 represents a perspective view of a mattress skirt.

Referring now to the drawings, where a mattress skirt is shown in FIG. 1 and generally referred to with numeral 10, it can be observed that it basically includes, among other features, a vertical panel 12, a horizontal panel 14, a corner panel 18, an end 19, pockets 20, an edge 21, a batten 22, a seam 24, a seam 26, a seam 28, a seam 30, a seam 32, an opening 34 and an edge 36.

This version of a mattress skirt shown in FIG. 1 is adapted to partially cover and conceal an end of a mattress and box spring combination. It generally has four panels including the vertical panel 12 that is connected to the horizontal panel 14 along the seam 28 so that the vertical panel 12 and horizontal panel 14 are unified. The seam 28, during use, lies generally along a seam between the mattress and box spring onto which the mattress skirt is applied.

In a typical application of the mattress skirt the horizontal panel 14 and vertical panel 12 are oriented about ninety degrees from each other. Similarly, the corner panel 16 is attached to the horizontal panel 14 at seam 32 at about ninety degrees. The corner panel 16 on an adjacent edge is attached to the vertical panel 12 at seam 30 at about ninety degrees.

The corner panel 18 is attached to the horizontal panel 14 at seam 24 at about ninety degrees. The corner panel 18 on an adjacent edge is attached to the vertical panel 12 at seam 26 at about ninety degrees.

In typical use the corner panel 18 and corner panel 16 are roughly parallel to each other and are both roughly perpendicular to the horizontal panel 14 and vertical panel 12.

A plurality of pockets 20 are provided integral to the horizontal panel 14. The pockets 20 are dimensioned to fit a batten 22 inside the pocket 20. The pockets 20 have an opening 34 on an edge of the pocket nearer the seam 28. In the mattress skirt shown in FIG. 1 the pocket 20 has a closed end 19 on an edge of the pocket 20 nearer the edge 21. The seam 19 can be coincidental to the edge 19 or within a couple of inches of the edge 21 and still remain within the spirit and scope of the several variations of the device as shown.

A mattress skirt may have many pockets 20. In a version of the device the pockets are spaced equally from about seam 24 at one side of the horizontal panel 14 to the seam 32 at an opposite side of the horizontal panel 14.

Preferably, the number, spacing and orientation of the pockets 20 are adapted to allow a user of the mattress skirt, with the use of batten 22 or other analogous structure, to easily insert the horizontal panel 14 securely between a mattress and box spring of the bed onto which the mattress skirt is applied.

Generally, the number of pockets 20 for a common sized bed is between about two and twenty. For the use of the mattress skirt with some types of mattresses the insertion of the horizontal panel 14 is easier with at least pockets near where the corners of the bed would lie. For example, in some applications of a mattress skirt such as that shown in FIG. 1 at least the right-most and left-most pockets 20 would be present and likely one or more additional pockets located in the middle area between those pockets 20.

The number of pockets 20 may be varied based on factors such as the characteristic of the material from which the horizontal panel 14 is constructed, the weight of the mattress, the materials from which the mattress and/or box spring is made, the nature and/or construction material of the battens (for example the net friction coefficient or rigidity) or other such physical characteristics.

Generally, the battens 22 are made of a thin and rigid material, such as, wood, metal, fiberboard, plastic. Other suitable materials well known in the art may be equally effective. When the batten 22 is inserted into any of the pockets 20, an end of the batten 22 contacts the end 19 of the pocket 20 and can thus push the pocket 20 and connected horizontal panel 14 between a mattress and box spring leaving the vertical panel 12, corner panel 16 and corner panel 18 exposed and draping over the edge of the box spring.

Figure 2:
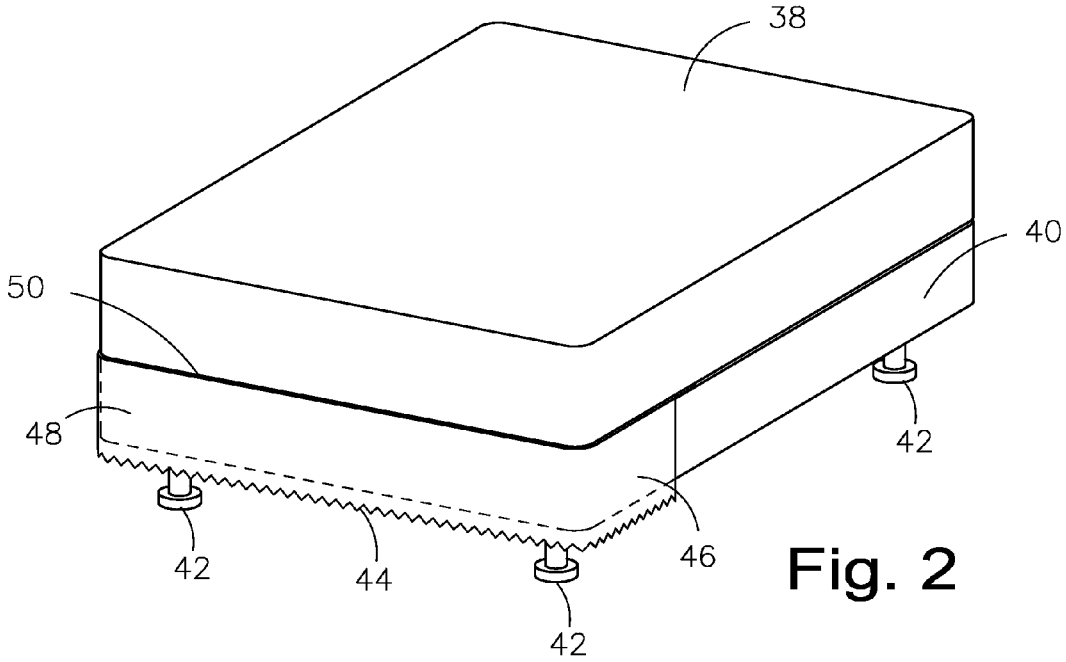
FIG. 2 shows a perspective view of a mattress skirt as it might be applied to a mattress and box spring.

Now referring to FIG. 2, read in context with the other drawings, a mattress skirt including a mattress 38, a box spring 40, feet 42, an edge 44, a corner panel 46, a vertical panel 48 and a seam 50 are shown. FIG. 2 should be read in light of the other figures for both analogous elements in form and function as well as described and shown variations and optional characteristics within the scope of the mattress skirt as shown and described herein.

FIG. 2 shows a variety of a mattress skirt as it might be applied in conjunction with a typical mattress 38 and box spring 40. A batten is inserted into a pocket on a horizontal panel to push that horizontal panel between the mattress 38 and box spring 40 leaving the vertical panel 48 and corner panel 46 exposed. Not shown in FIG. 2, but optionally present, is a complementary corner panel opposite the corner panel 46 that is connected to the vertical panel 48 and horizontal panel in a similar fashion to the corner panel 18 shown in FIG. 1.

For any of the variations of mattress skirts shown in the figures and described herein there may be a batten inserted into each pocket. Alternatively, one batten may be used to press one pocket with the integral horizontal panel between a mattress and box spring then that batten is removed by sliding it out of the pocket and then re-inserted into another pocket to press another portion of the horizontal panel between the mattress and box spring. By repeating this process of using a batten to insert one portion of the horizontal panel and then moving to another pocket in another area of the horizontal panel the entire horizontal panel may be neatly, quickly and easily inserted between the mattress and box spring.

The horizontal panel 14, or other analogous horizontal panels shown in the other examples of mattress skirts, may be held in place between the mattress and box spring by the frictional force generated by gravity pulling the mattress down on top of the box spring.

The materials of which the mattress, box spring and horizontal panel are constructed may be adjusted and adapted to increase or decrease the degree of frictional engagement of the mattress skirt onto the bed. For example, the pockets and/or horizontal panel could be made of a slippery material to reduce the force required to insert or remove the horizontal panel. Conversely, a rougher horizontal panel (or one otherwise adapted to increase the net friction between the bed and horizontal panel) could be adapted to increase the frictional engagement of the mattress skirt between the mattress and box spring.

Similarly, the depth that the horizontal panel is inserted between the mattress and box spring is generally and roughly similar to the distance between the edge 21 and the seam 28. This distance may be adapted to insert the horizontal panel further or shallower between the mattress and box spring to affect the force required to insert or remove the horizontal panel between the mattress and box spring. The frictional force may be also taken into account when selecting the dimension of the horizontal panel between the seam 28 and edge 21.

For illustrative purposes and not intended to be limiting, to be compatible with a common mattress and box spring, the horizontal panel of a mattress skirt could have a depth (the distance between the edge 21 and seam 28) of somewhere between about four inches and twenty four inches. Obviously, this range could be expanded or diminished depending on the amount of friction and material characteristics of both the bed and the components of mattress skirt or other factors that influence the interaction between the various elements.

FIG. 2 shows a mattress skirt on only one edge of a bed. In actual use, a user of the device would often elect to use one mattress skirt, such as the one shown in FIG. 1 on each edge of the bed. When adjacent edges of a bed have a mattress skirt applied the corner panels of adjacent mattress skirts will overlap. This tends to create a visual barrier from viewing the box spring underneath. This can also aid in limiting the amount of dust that can migrate under the bed thereby keeping the under-bed area relatively free of dust.

When one applies a mattress skirt to a bed they would typically complete the application of one copy onto one side of the bed by using a batten pushed systematically into each of the pockets to press the horizontal panel to the point where the seam 50 is about at the length of the edge of the box spring 40. In other words, to the point where the vertical panel 48 is laying about on the outwardly facing edge of the box spring 40 so that that side of the box spring 40 is covered.

The height of the vertical panel 48, meaning the distance between the seam 50 and the edge 44 is sufficient to act as a skirt by covering a portion of the edge of the box spring 40. This distance could typically range from a couple of inches to several feet.

A way to derive a possible height of the vertical panel would be to measure the distance from the plane defined by the intersection of the mattress 38 and box spring 40 to the floor onto which the bed rests. This distance would be the height of the vertical panel 48. In this example, the mattress skirt would then touch the floor when the horizontal panel (not identified in FIG. 2 but a similar horizontal panel 14 is shown in FIG. 1) is fully inserted between the mattress 38 and box spring 40.

The height of the vertical panel 48 could be shorter or longer than in the example, above. It is really a question of style. Some users may prefer a vertical panel that touches the floor while others may prefer that the vertical panel 48 terminate above the floor level. One reason could be that the decorating style requires that the feet 42 of the bed be exposed to view beneath the mattress skirt.

The lower edge 44 of the example of a mattress skirt shown in FIG. 2 includes a decorative feature. In this example a type of scalloped edge is shown. It obviously could be hemmed in a variety of styles and patterns to lend an aesthetic quality to the edge 44. Alternatively, the edge 44 could include a weighted edge, for example piping along the edge 44 to encourage the vertical panel 48 to lay flatter against the edge of the box spring 40 under the additional weight of an embellished edge.

The edge 44 could also be straight or have any other decorative pattern sewn in or otherwise attached. In yet another example a more elaborate edge treatment such as a lace border, tassels, fringe or other type of decoration known in the sewing arts could be applied with similar practical effect.

Figure 3:
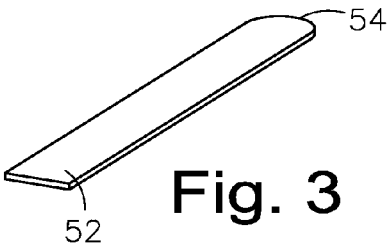
FIG. 3 illustrates a perspective view of a batten.
Figure 4:
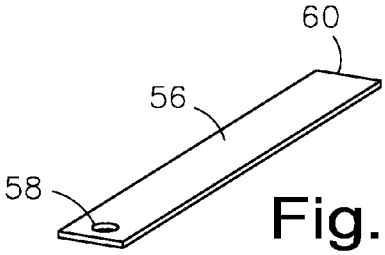
FIG. 4 is a representation of a perspective view of a batten.

FIGS. 3 and 4 show examples of what a batten 52 and a batten 56, respectively, could look like. The point 54 could be rounded or pointed and is particularly adapted to help guide the batten 52 into a pocket on a horizontal panel. This could be especially useful when re-straightening a mattress skirt that is already partially between a mattress and box spring. With this point 54 feature one could use the batten to probe for a pocket and when found the batten could be inserted further to drive the pocket and attached horizontal panel deeper between the mattress and box spring to the appropriate depth.

The end 60 on batten 56 is shaped more square so that it might seat more securely when fully inserted into the pocket. A grip 58 is provided to allow an installer of the mattress skirt to more easily extricate the batten 56 from a pocket. Any combination of features on the batten 52 and batten 56 could be mixed and matched for an effective tool to push the horizontal panel between the mattress and box spring.

Since a pocket and a batten are used together they are generally dimensioned to be of a similar size so that the batten will fit inside the pocket and will also be able to bottom out in the pocket to ensure that a horizontal panel can be fully inserted between a mattress and box spring without having to insert the users hand between the mattress and box spring. This avoid lifting the mattress over the box spring when inserting the horizontal panel of the mattress skirt.

For some applications, some insertion of the hand between the mattress and box spring may be necessary to push the batten fully between the mattress and box spring to hide the batten between the mattress and box spring during use or when installing the mattress skirt. The battens may be left between the mattress and box spring during use of the bed either inside a pocket or simply stored between the mattress and box spring.

By way of example only and not a precise measurement but instead to ensure enablement of the use and manufacture a possible thickness of the batten could be about an eighth of inch for some materials. However, the known characteristics of some materials that may be suitable for batten construction could be less or more, possibly less than a sixty-fourth of an inch or possibly up to about a half of an inch. Still merely exemplary of dimensions a batten that would clearly fall within the scope of the essence of any of the mattress skirts described herein, the length could be similar to the depth the horizontal panel, in this example the length of a batten could be about sixteen inches long and about five inches wide. Of course smaller and larger of any of these dimensions are to be understood as within the scope of reasonable variation.

Figure 5:
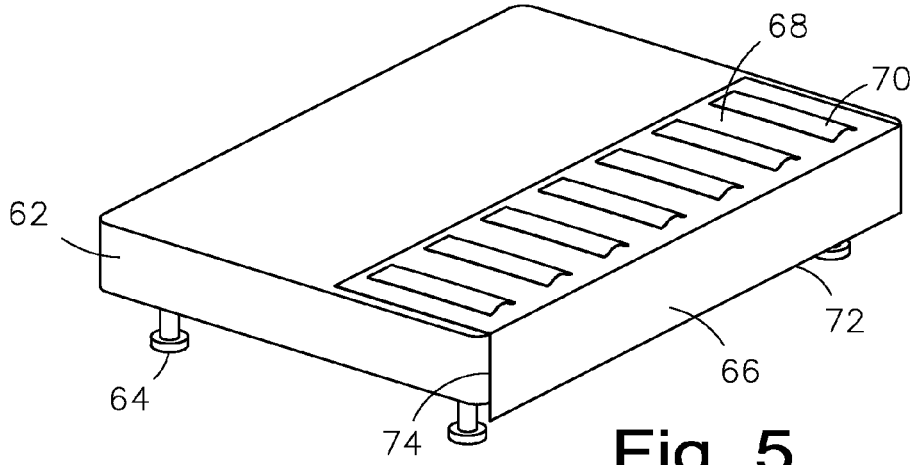
FIG. 5 is a perspective view of a mattress skirt as it might be positioned on a bed.

FIG. 5 shows a mattress skirt and bed having, inter alia, a box spring 62, feet 64, a vertical panel 66, a horizontal panel 68, pockets 70, an edge 72 and an edge 74.

A difference between the mattress skirt shown in FIG. 1 and that shown in FIG. 5 is that the version in FIG. 5 does not include an analogous structure to the side panel 16 and side panel 18 that are present in FIG. 1.

A reason for this difference is to conserve on material and construction costs. For example, a reasonable application of a bed skirt system to a bed may include the use of one mattress skirt similar in design to that shown in FIG. 5 on each of two opposite sides of bed. In this example, the left and right sides of the bed as opposed to the head or foot of the bed. The mattress skirt shown in FIG. 5 would not wrap around the corners onto the head or foot of the bed because they lack features equivalent to the side panels 16 and 18. Then, a mattress skirt similar to the design of that demonstrated in FIG. 1 would be installed at the foot edge of the bed. As is now apparent, the mattress skirt at the foot of the bed would indeed include features analogous to the corner panel 16 and corner panel 18 which would wrap around and over the edges of the mattress skirts on the vertical edge of the box spring at the corners of adjacent individual mattress skirts. A mattress skirt similar to the one shown in FIG. 1 would then also be optionally placed also on the head of the bed to similarly wrap around the vertical corners of the box spring creating an apparently seamless mattress skirt around the entire periphery of the box spring.

For beds that have a side against a headboard or wall it would be reasonable to have three mattress skirts on three adjacent sides. The edge of the bed that cannot be seen would not necessarily need its own mattress skirt because that side is not visible.

Generally, the versions of the mattress skirts shown in FIG. 1 can be effectively used in combination with the version shown in FIG. 5. If used in combination it would be possible to alternate the FIG. 5 version with the FIG. 1 version as the mattress skirt on adjacent sides of a bed. There would be sufficient overlap at the corners provided by the corner panels 16 and 18 to create a seamless appearing mattress skirt around multiple edges of the bed.

It is certainly possible to use multiple copies of the mattress skirt as shown in FIG. 5 on each adjacent side of a bed. However, this might result in gaps between the adjacent mattress skirts thus allowing the vertical corners of the box spring to be visible because of the absence of the corner panels 16 and 18 in the version of mattress skirt shown in FIG. 1 and described herein.

In another contemplated application where a bed is nestled into a three sided cove and only one edge of the box spring is visible, it could be desirable to use a single copy of the mattress skirt as shown in FIG. 1 without additional sides of the box spring covered. In this case the length the side panels 16 and 18 could be dimensioned to cover only the amount of box spring that is exposed outside of the cove.

Figure 6:
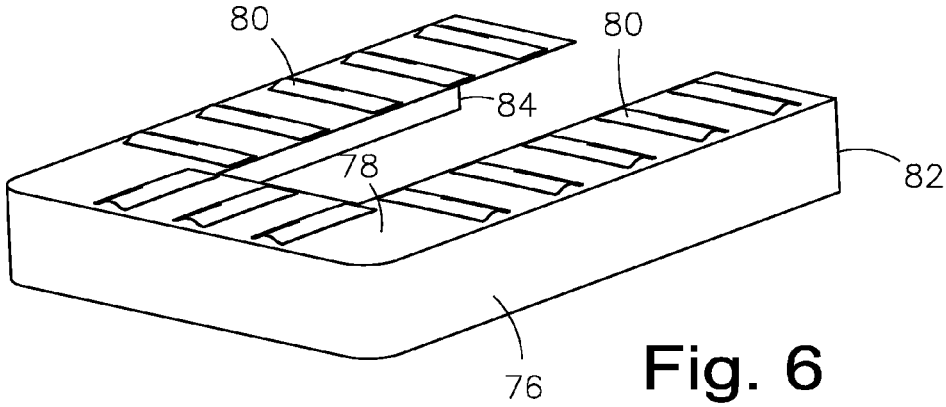
FIG. 6 is a perspective view a mattress skirt.

FIG. 6 is another variation of a mattress skirt where multiple adjacent sides of a bed are covered by a contiguous mattress skirt and is shown to include, inter alia, a vertical panel 76, a horizontal panel 78, pockets 80, an edge 82 and an edge 84.

Similar to the other varieties of mattress skirts shown and described herein, there are a plurality of pockets 80 spaced in position on the top side of the horizontal panel 78. The pockets 80 are each adapted to be used with a preselected batten, for example one having similar features to those shown in FIGS. 1, 3 and 4 (or combinations thereof).

The battens and pocket combination are used in like fashion as the other versions of the mattress skirt in that the battens are generally stiff and are inserted into and bottom out in the pockets so that the horizontal panel 78 is secured between a mattress and box spring.

Obviously the view of the device shown in FIG. 6 is laid out as it might be used with a mattress and box spring but the mattress and box spring have not been depicted in this figure for clarity. This iteration in FIG. 6 by nature of it having three sides and therefore is able to cover three adjacent sides of a box spring could be used effectively on a bed that has a headboard against a wall; leaving three sides exposed to the room (i.e. the left side, right side and foot). This configuration could be advantageous when there is a headboard blocking access to the intersection between the mattress and box spring on the head of the bed. In this example, edge 84 and edge 82 would lie at or near the plane of the headboard.

FIG. 6 is merely an example of a mattress skirt with three sides of coverage for a bed. This could readily be adapted to use on two adjacent sides or to fully encircle all four sides of a bed. In the case of four sides coverage it may be advantageous to cover a portion more that the just the perimeter. In other words, the sum width of the vertical panel 76 would be a little longer than the length of the perimeter of the mattress onto which it is applied. This way, by having some overlap there will be no visible joint where the two ends meet after encircling the bed. Alternatively, the seam could be hidden in a discrete location on the box spring where it is not readily visible.

Figure 7:
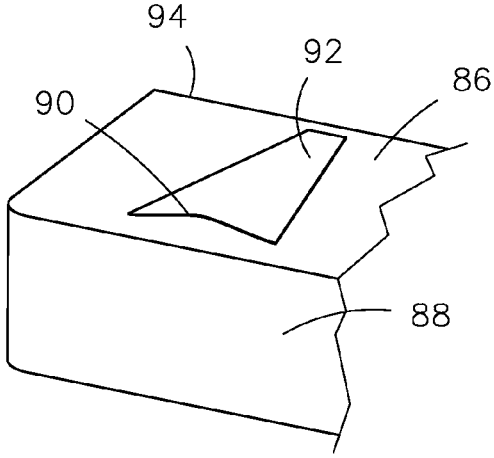
FIG. 7 is a partial perspective view of a mattress skirt.
Figure 8:
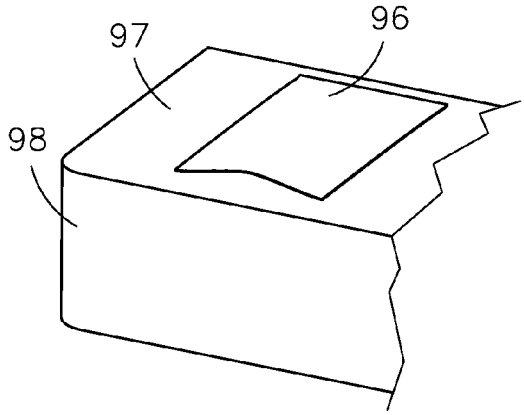
FIG. 8 is a partial perspective view of a mattress skirt.

FIGS. 7 and 8 show close-up views of possible variations of pocket designs that include a horizontal panel 86, a vertical panel 88, an opening 90, a pocket 92, a seam 94, a pocket 96, a horizontal panel 97 and a vertical pane 98.

The alternative pocket 92 shown in FIG. 7 has cone shape with a wider opening 91 than the closed end near the seam 94. This shape can be advantageous when the horizontal panel 86 is partially between an mattress and box spring and the pocket 92 is hidden from view. The installer of the mattress skirt may try to blindly probe between the mattress and box spring on the top side of the horizontal panel 86 to find the opening 90. The tapering pocket 92 narrows as it approaches the seam 94 at the closed end of the pocket 92 where a batten can be used to press the mattress skirt into its useful position.

FIG. 8 shows a pocket 96 dimensioned closer to a square than rectangular. This version might be best paired with a batten of similar shape. For example, if the depth of the horizontal panel is eighteen inches then the depth of the pocket 96 and depth of an appropriate batten might be about fifteen inches. Following along in this same example, the width of the batten and pocket could also effectively be about fifteen inches wide. Of course, these stated examples of dimensions could obviously vary depending on, for example, preferences of the user, width of the mattress and box spring, nature of the materials used for the batten, box spring, mattress and mattress skirt and other factors that would obvious of one skilled in the bedding art.

Any of the several aspects and feature of the several varieties of pockets could reasonably be mixed and match and remain with the scope of the disclosure. The examples presented are merely illustrative and to enable practicing the essence of the principals as described for an effective mattress skirt.

A mattress skirt can be fairly described as being configured for use with a most types of mattresses and includes, among other features, a horizontal panel, a vertical panel, a first corner panel, a second corner panel and a batten. In some applications multiple battens will be used. The horizontal panel lays parallel to the surface of the bed and has a first edge opposing and parallel to a third edge and a second edge opposing and parallel to a fourth edge. The vertical panel drapes down over the edge of the bed and has a first edge opposing and parallel to a third edge and a second edge opposing and parallel to a fourth edge. The third edge of the horizontal panel is dimensioned to match a length of a side of a predetermined mattress. This is so that the entire edge of the mattress can be covered by the skirt. The first edge of the vertical panel is affixed to the entire length of the third edge of the horizontal panel. This seam runs along the corner of the edge of the mattress. The first corner panel has a first edge adjacent to a second edge. The first corner panel is affixed on the first edge to the second edge of the horizontal panel and on the second edge to the second edge of the vertical panel. This essentially creates a visual effect of the vertical panel extending longer than the edge of the bed, wrapping around the adjacent edges of the bed. This prevents viewing the edge of the bed by creating an overlap with adjacent skirt panels. The second corner panel has a first edge adjacent to a second edge. The second corner panel is affixed on the first edge to the fourth edge of the horizontal panel and on the second edge to the fourth edge of the vertical panel. The horizontal panel includes a plurality of integral pockets on a top surface. The pockets are generally oriented perpendicular to the edge of the bed so that the battens can be inserted into the pockets to push the horizontal panel between the mattress and box spring, leaving the vertical panel to cover the vertical edge of the box spring, or whatever type of sleeping device to which the mattress skirt is applied. Each integral pocket has an opening facing the third edge of the horizontal panel and a closed end facing the first edge of the horizontal panel so that the batten can press against the closed end of the pocket during installation of the mattress skirt. The batten is dimensioned to fit inside of a pocket. There may be a batten for each pocket. Alternately a single batten can be used to press one pocket between the mattress and box spring, then removed to insert the other pockets into place. The battens can be left in place during use of the bed or can be removed if desired.

Generally, the mattress skirt's horizontal panel is disposed between layers in bed. The bed can be any type of bedding system, for example, a mattress and box spring combination, a futon, a water bed, a mattress on a frame or any other type of bed. When determining the relative size of the different elements, a successful size could be where the distance between said pockets is greater than or equal to a width of the horizontal panel. Alternatively, a batten could a width less than or equal to a width of the horizontal panel. These dimensions can be effective where the width of the pockets is less than the length.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A mattress skirt configured for use with a mattress comprised of:

a horizontal panel, a vertical panel, a first corner panel, a second corner panel and a batten;

the horizontal panel has a first edge opposing and parallel to a third edge and a second edge opposing and parallel to a fourth edge;

the vertical panel has a first edge opposing and parallel to a third edge and a second edge opposing and parallel to a fourth edge;

the third edge of the horizontal panel is dimensioned to match a length of a side of a predetermined mattress;

the first edge of the vertical panel is affixed to the entire length of the third edge of the horizontal panel;

the first corner panel has a first edge adjacent to a second edge;

the first corner panel is affixed on the first edge to the second edge of the horizontal panel and on the second edge to the second edge of the vertical panel;

the second corner panel has a first edge adjacent to a second edge;

the second corner panel is affixed on the first edge to the fourth edge of the horizontal panel and on the second edge to the fourth edge of the vertical panel;

the horizontal panel includes a plurality of integral pockets on a top surface;

each integral pocket has an opening facing the third edge of the horizontal panel and a closed end facing the first edge of the horizontal panel;

the batten is dimensioned to fit inside of a pocket.

2. A mattress skirt as disclosed in claim 1 where the horizontal panel is disposed between layers in bed.

3. A mattress skirt as disclosed in claim 2 where the bed is any of a mattress and box spring combination, a futon, a water bed or a mattress on a frame.

4. A mattress skirt as disclosed in claim 1 where a distance between said pockets is greater than or equal to a width of the horizontal panel.

5. A mattress skirt as disclosed in claim 1 where a batten has a width less than or equal to a width of the horizontal panel.

6. A mattress skirt as disclosed in claim 2 where a distance between said pockets is greater than or equal to a width of the horizontal panel.

7. A mattress skirt as disclosed in claim 2 where a batten has a width less than or equal to a width of the horizontal panel.

* * * * *